US009541311B2

(12) United States Patent
Hinde et al.

(10) Patent No.: US 9,541,311 B2
(45) Date of Patent: Jan. 10, 2017

(54) CASCADE REFRIGERATION SYSTEM WITH MODULAR AMMONIA CHILLER UNITS

(75) Inventors: David K. Hinde, Atlanta, GA (US); John D. Bittner, Bethlehem, GA (US); Shitong Zha, Conyers, GA (US); Joseph R. Poland, Decatur, GA (US)

(73) Assignee: Hill Phoenix, Inc., Conyers, GA (US)

( * ) Notice: Subject to any disclaimer, the term of this patent is extended or adjusted under 35 U.S.C. 154(b) by 1428 days.

(21) Appl. No.: 12/948,442

(22) Filed: Nov. 17, 2010

(65) Prior Publication Data

US 2012/0117996 A1 May 17, 2012

(51) Int. Cl.
*F25B 43/02* (2006.01)
*F25B 41/00* (2006.01)
(Continued)

(52) U.S. Cl.
CPC ..... *F25B 7/00* (2013.01); *F25B 9/002* (2013.01); *F25B 2600/21* (2013.01)

(58) Field of Classification Search
CPC ..... F25B 1/10; F25B 5/02; F25B 7/00; F25B 31/002; F25B 31/004; F25B 39/02; F25B 39/028; F25B 40/00; F25B 40/02; F25B 41/00; F25B 43/00; F25B 43/02; F25B 45/00; F25B 49/022; F25B 49/025; F25B 2309/002; F25B 2309/06; F25B 2313/0233; F25B 2339/02; F25B 2339/024; F25B 2341/064; F25B 2400/06; F25B 2400/075; F25B 2400/13; F25B 2400/16; F25B 2500/16; F25B 2600/02; F25D 17/02; F24F 13/20
(Continued)

(56) References Cited

U.S. PATENT DOCUMENTS 2,661,836 A * 12/1953 Bernard ..... 206/320
2,797,068 A 6/1957 McFarlan
(Continued)

FOREIGN PATENT DOCUMENTS

EP 0 602 911 B1 6/1994
EP 0 675 331 B1 10/1995
(Continued)

OTHER PUBLICATIONS

Annex to Form PCT/ISA/206 Communication Relating to the Results of the Partial International Search, Application No. PCT/US 03/34606, 2 pages.
(Continued)

*Primary Examiner* — Henry Crenshaw
(74) *Attorney, Agent, or Firm* — Foley & Lardner LLP

(57) ABSTRACT

A cascade refrigeration system includes an upper portion having at least one modular chiller unit that provides cooling to at least one of a low temperature subsystem having a plurality of low temperature loads, and a medium temperature subsystem having a plurality of medium temperature loads. The modular chiller unit includes a refrigerant circuit having at least a compressor, a condenser, an expansion device, and an evaporator. An ammonia refrigerant mixed with a soluble oil circulates within the refrigerant circuit. A control device may be programmed to modulate the position of the expansion device so that a superheat temperature of the ammonia refrigerant near an outlet of the evaporator fluctuates within a substantially predetermined superheat temperature range to positively return soluble oil from the evaporator to the compressor.

26 Claims, 6 Drawing Sheets

(51) Int. Cl.

| | |
|---|---|
| ***F25D 11/00*** | (2006.01) |
| ***F25B 43/00*** | (2006.01) |
| ***F25B 7/00*** | (2006.01) |
| ***F25B 9/00*** | (2006.01) |

(58) Field of Classification Search

USPC ..... 62/79, 84, 99, 113, 114, 174, 175, 185,62/193, 199, 200, 225, 228.1, 230, 259.1, 335,62/471, 509, 510, 512, 513, 516, 525, 612

See application file for complete search history.

(56) References Cited

U.S. PATENT DOCUMENTS 3,102,399 A * 9/1963 Gershon Meckler ..... 62/271
4,014,182 A 3/1977 Granryd
4,122,686 A 10/1978 Lindahl et al.
4,429,547 A 2/1984 Granryd
4,484,449 A 11/1984 Muench
4,575,595 A * 3/1986 Gill ..... H01H 9/20 200/50.3
4,750,335 A 6/1988 Wallace et al.
4,765,150 A 8/1988 Persem
4,984,435 A 1/1991 Seino et al.
RE33,620 E 6/1991 Persem
5,042,262 A 8/1991 Gyger et al.
5,046,320 A 9/1991 Loose et al.
5,048,303 A 9/1991 Campbell et al.
5,170,639 A 12/1992 Datta
5,212,965 A 5/1993 Datta
5,217,064 A 6/1993 Kellow et al.
5,228,581 A 7/1993 Palladino et al.
5,335,508 A 8/1994 Tippmann
5,351,498 A 10/1994 Takahashi et al.
5,386,709 A 2/1995 Aaron
5,426,952 A * 6/1995 Bessler ..... F25B 41/062 62/211
5,431,547 A 7/1995 Boyko
D361,226 S 8/1995 Jones et al.
D361,227 S 8/1995 Jones et al.
5,438,846 A 8/1995 Datta
5,475,987 A 12/1995 McGovern
5,544,496 A 8/1996 Stoll et al.
5,596,878 A 1/1997 Hanson et al.
5,683,229 A 11/1997 Stoll et al.
5,688,433 A * 11/1997 Kasahara et al. ..... 252/68
5,743,110 A 4/1998 Laude-Bousquet
6,067,814 A 5/2000 Imeland
6,089,033 A 7/2000 Dube
6,094,925 A 8/2000 Arshansky et al.
6,112,532 A 9/2000 Bakken
6,148,634 A 11/2000 Sherwood
6,170,270 B1 1/2001 Arshansky et al.
RE37,054 E 2/2001 Sherwood
6,185,951 B1 2/2001 Lane et al.
6,202,425 B1 3/2001 Arshansky et al.
6,205,795 B1 3/2001 Backman et al.
6,212,898 B1 4/2001 Ueno et al.
6,286,322 B1 9/2001 Vogel et al.
6,349,564 B1 * 2/2002 Lingelbach et al. ..... 62/510
6,385,980 B1 5/2002 Sienel
6,393,858 B1 5/2002 Mezaki et al.
6,405,558 B1 6/2002 Sheehan
6,418,735 B1 7/2002 Sienel
6,449,967 B1 9/2002 Dube
6,463,757 B1 * 10/2002 Dickson ..... F25B 40/00 29/890.06
6,467,279 B1 10/2002 Backman et al.
6,481,231 B2 11/2002 Vogel et al.
6,494,054 B1 12/2002 Wong et al.
6,502,412 B1 1/2003 Dube
6,568,195 B2 * 5/2003 Kaimai et al. ..... 62/114
6,574,978 B2 6/2003 Flynn et al.
6,631,621 B2 10/2003 VanderWoude et al.
6,658,867 B1 12/2003 Taras et al.
6,672,087 B1 1/2004 Taras et al.
6,708,511 B2 3/2004 Martin
6,722,145 B2 4/2004 Podtchereniaev et al.
6,745,588 B2 6/2004 Kahler
6,775,993 B2 8/2004 Dube
6,843,065 B2 1/2005 Flynn
6,883,343 B2 4/2005 Lane et al.
6,889,514 B2 5/2005 Lane et al.
6,889,518 B2 5/2005 Lane et al.
6,915,652 B2 7/2005 Lane et al.
6,951,117 B1 * 10/2005 Wightman ..... 62/200
6,968,708 B2 11/2005 Gopalnarayanan et al.
6,981,385 B2 1/2006 Arshansky et al.
6,983,613 B2 1/2006 Dube
7,000,413 B2 2/2006 Chen et al.
7,065,979 B2 6/2006 Arshansky et al.
7,121,104 B2 10/2006 Howington et al.
7,159,413 B2 1/2007 Dail
7,275,376 B2 10/2007 Swofford et al.
RE39,924 E 11/2007 Dube
7,357,000 B2 4/2008 Schwichtenberg et al.
7,374,186 B2 5/2008 Mason et al.
7,424,807 B2 9/2008 Sienel
7,610,766 B2 11/2009 Dube
7,628,027 B2 12/2009 Shapiro
7,913,506 B2 3/2011 Bittner et al.
2001/0023594 A1 9/2001 Ives
2001/0027663 A1 10/2001 Zeigler et al.
2002/0040587 A1 * 4/2002 Flynn ..... C09K 5/045 62/430
2002/0066286 A1 6/2002 Alsenz
2003/0019219 A1 1/2003 Viegas et al.
2003/0029179 A1 2/2003 Vander Woude et al.
2004/0159111 A1 * 8/2004 Takegami ..... F25B 13/00 62/84
2007/0056312 A1 * 3/2007 Kobayashi ..... 62/335
2007/0289326 A1 * 12/2007 Nishikawa et al. ..... 62/498
2008/0148751 A1 6/2008 Swofford
2008/0209921 A1 9/2008 Swofford
2008/0289350 A1 11/2008 Shapiro
2009/0000321 A1 1/2009 Hall
2009/0025404 A1 1/2009 Allen
2009/0107159 A1 * 4/2009 Mann et al. ..... 62/239
2009/0120108 A1 5/2009 Heinbokel et al.
2009/0120117 A1 * 5/2009 Martin et al. ..... 62/246
2009/0158612 A1 6/2009 Thilly et al.
2009/0260381 A1 10/2009 Bittner et al.
2009/0260389 A1 10/2009 Dube
2009/0272128 A1 11/2009 Ali
2009/0293517 A1 12/2009 Bittner
2009/0301112 A1 * 12/2009 Nelson ..... 62/112
2010/0023171 A1 1/2010 Bittner et al.
2010/0031697 A1 2/2010 Hinde et al.
2010/0071391 A1 3/2010 Lifson et al.
2010/0077777 A1 4/2010 Lifson et al.
2010/0115975 A1 5/2010 Mitra et al.
2010/0132399 A1 6/2010 Mitra et al.
2010/0199707 A1 8/2010 Pearson
2010/0199715 A1 8/2010 Lifson et al.
2010/0205984 A1 8/2010 Gu et al.
2010/0212350 A1 8/2010 Gu et al.
2011/0138823 A1 * 6/2011 Troutman et al. ..... 62/98
2012/0117996 A1 5/2012 Hinde et al.

FOREIGN PATENT DOCUMENTS

EP 1 134 514 A1 9/2001
EP 1 139 041 A2 10/2001
WO WO 2009/158612 A2 12/2009

OTHER PUBLICATIONS

U.S. Appl. No. 12/699,720, filed Feb. 3, 2010, Bittner et al.

* cited by examiner

CASCADE REFRIGERATION SYSTEM WITH MODULAR AMMONIA CHILLER UNITS

FIELD

The present invention relates to a cascade refrigeration system having an upper portion that uses a modular chiller unit having ammonia as a refrigerant to provide condenser cooling for a refrigerant in a low temperature subsystem (for cooling low temperature loads) and/or for chilling a liquid that is circulated through a medium temperature subsystem (for cooling medium temperature loads). The present invention relates more particularly to a cascade refrigeration system having a critically-charged modular chiller unit that uses a sufficiently small charge of ammonia to minimize potential toxicity and flammability hazards. The present invention also relates more particularly to a modular ammonia cascade refrigeration system that uses a soluble oil mixed with the ammonia refrigerant charge. The present invention relates more particularly still to a modular ammonia cascade refrigeration system that uses intentionally-unstable superheat control to ensure positive return of any soluble oil from an evaporator of the modular ammonia chiller unit.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Refrigeration systems typically include a refrigerant that circulates through a series of components in a closed system to maintain a cold region (e.g., a region with a temperature below the temperature of the surroundings). One exemplary refrigeration system includes a direct-expansion vapor-compression refrigeration system including a compressor. Such a refrigeration system may be used, for example, to maintain a desired low temperature within a low temperature controlled storage device, such as a refrigerated display case, coolers, freezers, etc. in a low temperature subsystem of the refrigeration system. Another exemplary refrigeration system includes a chilled liquid coolant circulated by a pump to maintain a desired medium temperature within a medium temperature storage device in a medium temperature subsystem of the refrigeration system. The low and/or medium temperature subsystems may each receive cooling from one or more chiller units in a cascade arrangement. The chiller units circulate a refrigerant through a closed-loop refrigeration cycle that includes an evaporator which provides cooling to the low temperature subsystem (e.g. as a condenser) and/or the medium temperature subsystem (e.g. as a chiller).

Accordingly, it would be desirable to provide a cascade refrigeration system having one or more modular chiller units capable of using ammonia as a refrigerant for providing condenser cooling in a low temperature subsystem of the refrigeration system, and/or for chilling a liquid coolant for circulation through a medium temperature subsystem of the refrigeration system.

SUMMARY

One embodiment of the invention relates to a cascade refrigeration system that includes an upper portion having at least one modular chiller unit that provides cooling to a low temperature subsystem having a plurality of low temperature loads, and/or a medium temperature subsystem having a plurality of medium temperature loads. The modular chiller unit includes a refrigerant circuit having at least a compressor, a condenser, an expansion device, and an evaporator. An ammonia refrigerant mixed with a soluble oil circulates within the refrigerant circuit. A control device may be provided that is programmed to modulate the position of the expansion device so that a superheat temperature of the ammonia refrigerant near an outlet of the evaporator fluctuates within a substantially predetermined superheat temperature range to flush an accumulation of the soluble oil from the evaporator.

Another embodiment relates to a modular ammonia chiller unit for a refrigeration system and includes a refrigerant circuit having at least a compressor, a condenser, an expansion device, an evaporator, an ammonia refrigerant, a soluble oil mixed with the ammonia refrigerant. A control device may be provided that is operated according to a control scheme configured to return an accumulation of the soluble oil from the evaporator to the compressor.

Yet another embodiment relates to a method of providing a cascade refrigeration system that is substantially HFC-free and includes the steps of providing a lower portion having a low temperature subsystem that uses carbon dioxide as a refrigerant to cool a plurality of low temperature loads, and/or a medium temperature subsystem that uses a water-glycol mixture as a liquid coolant to cool a plurality of medium temperature loads, and providing an upper portion having at least one modular chiller unit that provides cooling to the low temperature subsystem and the medium temperature subsystem, the modular chiller unit comprising a refrigerant circuit having at least a compressor, a condenser, an expansion device, and an evaporator, and charging the refrigerant circuit of the modular chiller unit with a critical charge amount of an ammonia refrigerant mixed with a soluble oil. A step may be provided for programming a control device to operate according to a control scheme configured to return an accumulation of the soluble oil from the evaporator to the compressor.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1A:
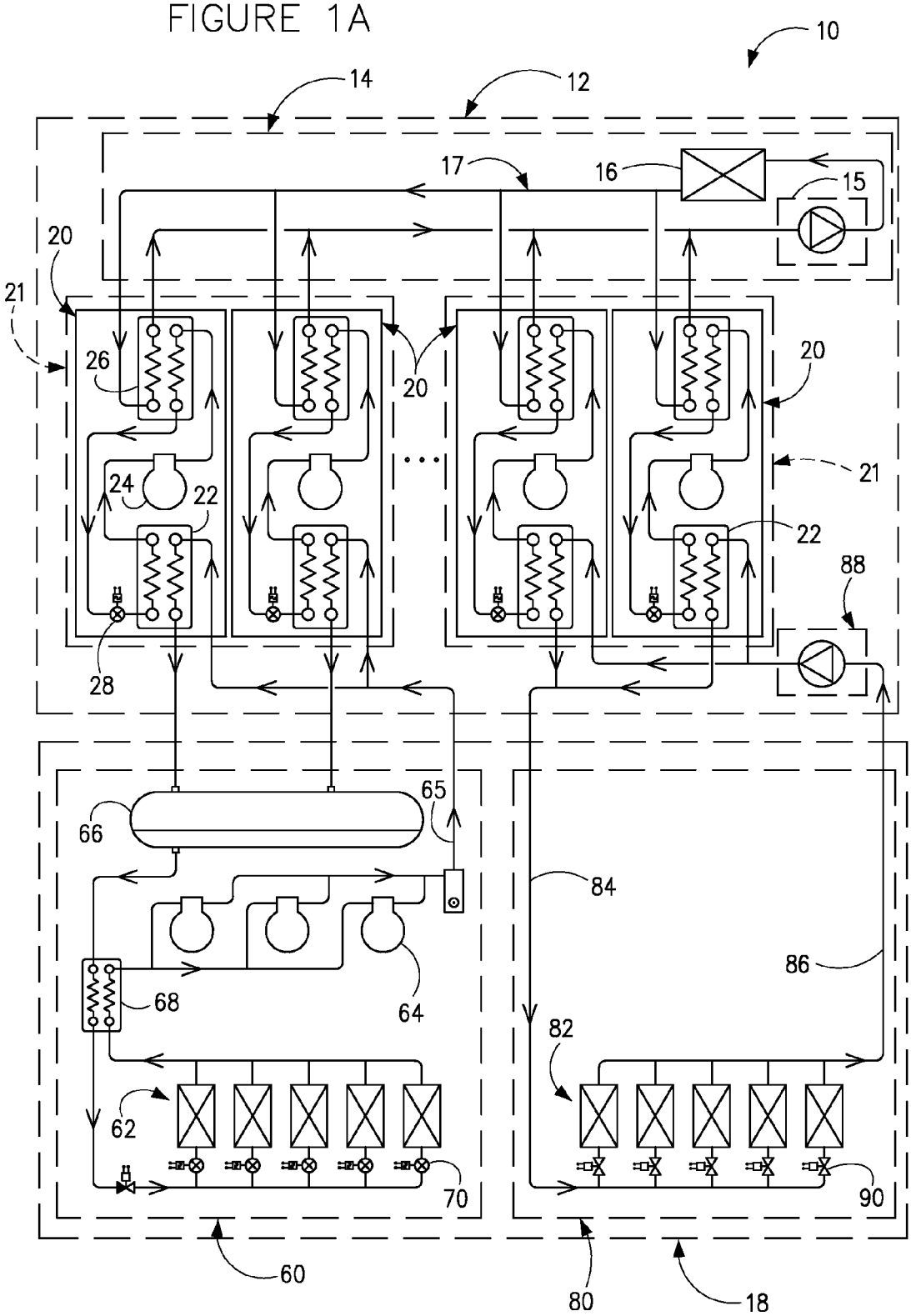
FIG. 1A is a schematic diagram of a cascade refrigeration system having modular ammonia chiller units according to an exemplary embodiment.
Figure 1B:
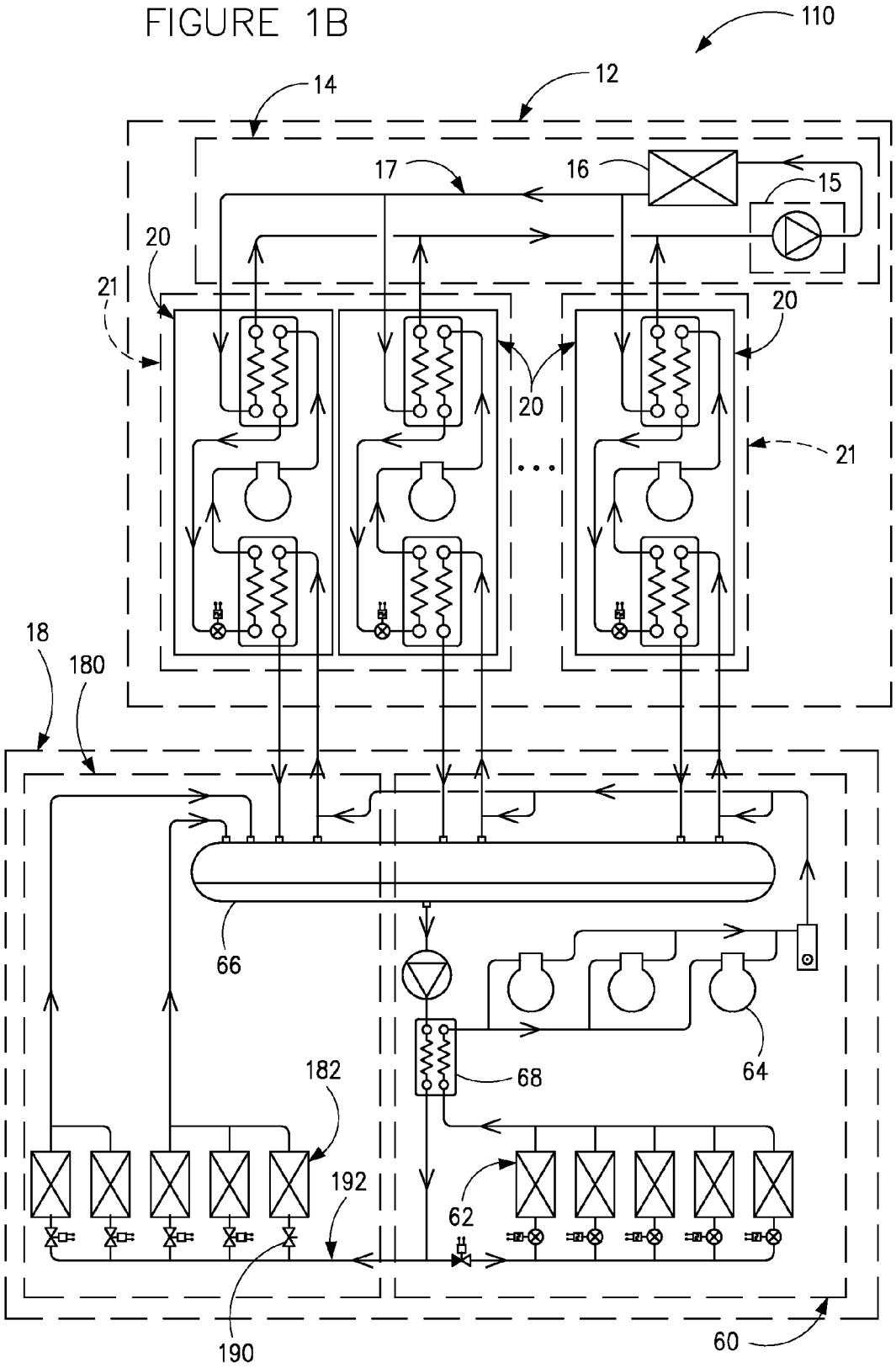
FIG. 1B is a schematic diagram of a cascade refrigeration system having modular ammonia chiller units according to an exemplary embodiment.

Referring to FIGS. 1A and 1B, a cascade refrigeration system 10 is shown according to an exemplary embodiment. The refrigeration system 10 of FIG. 1A is a cascade system that includes several subsystems or loops. According to an exemplary embodiment, the cascade refrigeration system 10, comprises an 'upper' portion 12 that includes one or more modular ammonia chiller unit 20 that provide cooling to a 'lower' portion 18 having a medium temperature subsystem 80 for circulating a medium temperature coolant (e.g. water, glycol, water-glycol mixture, etc.) and a low temperature subsystem 60 for circulating a low temperature refrigerant (such as a hydroflourocarbon (HFC) refrigerant, carbon dioxide (CO2), etc.).

The terms "low temperature" and "medium temperature" are used herein for convenience to differentiate between two subsystems of refrigeration system 10. Medium temperature subsystem 80 maintains one or more loads, such as cases 82 (e.g. refrigerator cases or other cooled areas) at a temperature lower than the ambient temperature but higher than low temperature cases 62. Low temperature subsystem 60 maintains one or more loads, such as cases 62 (e.g. freezer display cases or other cooled areas) at a temperature lower than the medium temperature cases. According to one exemplary embodiment, medium temperature cases 82 may be maintained at a temperature of approximately 20° F. and low temperature cases 62 may be maintained at a temperature of approximately minus (−) 20° F. Although only two subsystems are shown in the exemplary embodiments described herein, according to other exemplary embodiments, refrigeration system 10 may include more subsystems that may be selectively cooled in a cascade arrangement or other cooling arrangement.

An upper portion (e.g., the upper cascade portion 12) of the refrigeration system 10 includes one or more (shown by way of example as four) modular ammonia chiller units 20, that receive cooling from a cooling loop 14 having a pump 15, and one or more heat exchangers 16, such as an outdoor fluid cooler or outdoor cooling tower for dissipating heat to the exterior or outside environment. Outdoor fluid cooler 16 cools a coolant (e.g., water, etc.) that is circulated by pump 15 through cooling loop 17 to remove heat from the modular ammonia chiller units 20.

Figure 2:
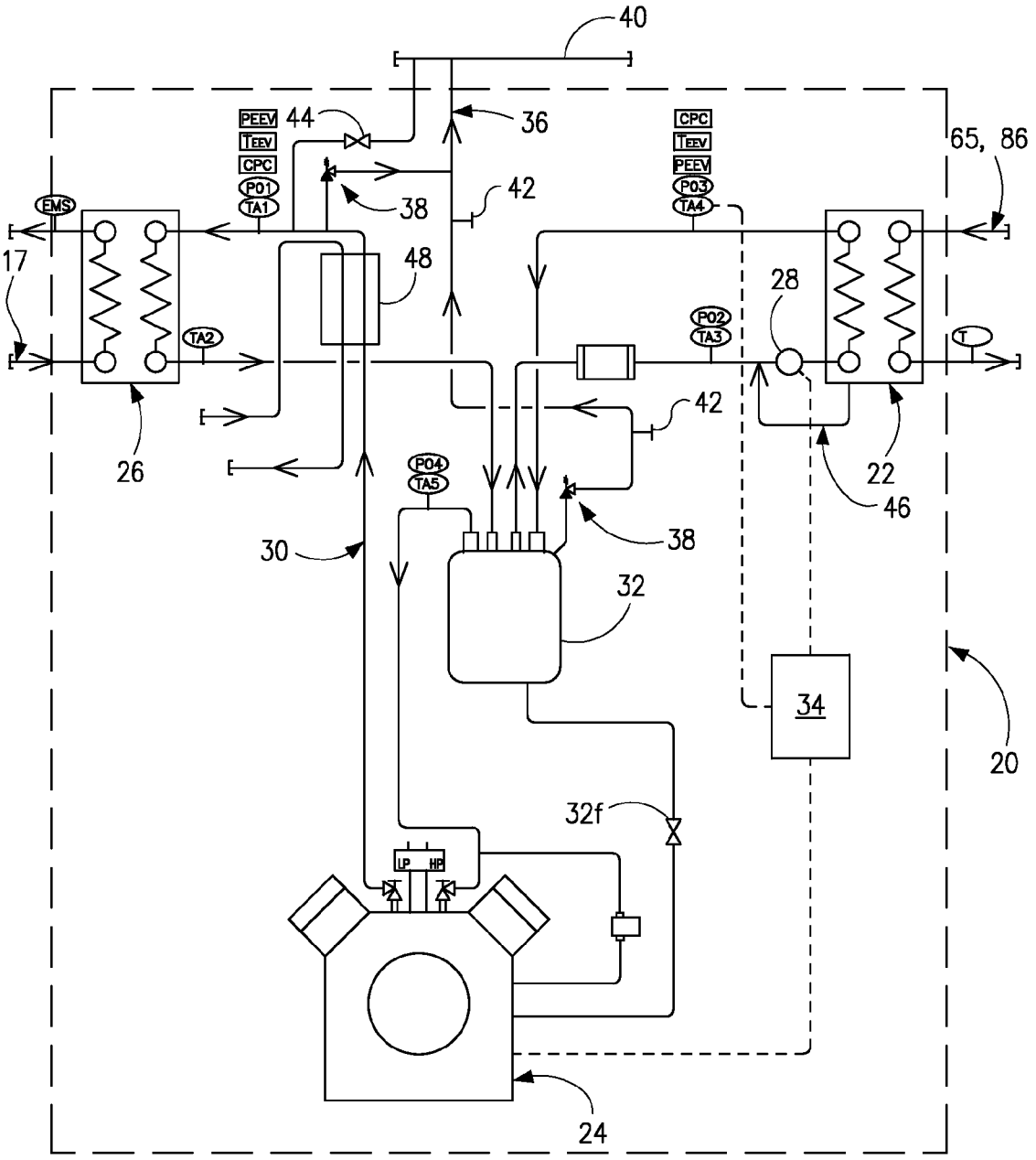
FIG. 2 is a schematic diagram of a modular ammonia chiller unit for the refrigeration system of FIG. 1 according to one exemplary embodiment.

One exemplary modular ammonia chiller unit 20 is shown in more detail in FIG. 2. Chiller unit 20 includes a critical charge of an ammonia refrigerant that is circulated through a vapor-compression refrigeration cycle including a first heat exchanger 22, a compressor 24, a second heat exchanger 26, and an expansion valve 28. In the first heat exchanger 22 (e.g. the evaporator, etc.), the ammonia refrigerant absorbs heat from an associated load such as the compressed hot gas refrigerant in line 65 from the low temperature subsystem 60, or from the circulating medium temperature liquid coolant in return header 86 from the medium temperature subsystem 80. In the second heat exchanger 26 (e.g. condenser, etc.), the refrigerant transfers (i.e. gives up) heat to a coolant (e.g. water circulated through cooling loop 17 by pump 15). The use of a water-cooled condenser is intended to maximize heat transfer from the ammonia refrigerant so that a minimum amount or charge of ammonia is required to realize the intended heat transfer capacity of the chiller unit. The coolant is circulated through heat exchanger 16 (which may be a fan-coil unit or the like, etc.) for discharging the heat to the atmosphere. According to one alternative embodiment, the heat exchanger 26 (condenser) in the modular ammonia chiller unit 20 may be an air-cooled heat exchanger. For example, the air-cooled heat exchanger may be a microchannel type heat exchanger. According to another alternative embodiment, the air-cooled microchannel condenser may further include an evaporative component (such as water spray/baffles, etc.) to further enhance heat transfer of the air-cooled microchannel condenser. According to another embodiment, heat exchanger 16 in the water circulation loop 17 may be (or otherwise include) any of a wide variety of heat reclamation devices, such as may be associated with a facility where system 10 is installed. According to an exemplary embodiment, the term 'critically charged' is understood to mean a minimally sufficient amount of ammonia refrigerant necessary to accomplish the intended heat removal capacity for the chiller unit, without an excess amount of refrigerant (such as might be accommodated in a receiver of a non-critically charged system or device).

Referring further to FIG. 1A, the low temperature subsystem 60 includes a closed-loop circuit circulating a refrigerant (e.g. CO2, HFC, etc.) through one or more low temperature cases 62 (e.g., refrigerated display cases, freezers, etc.), one or more compressors 64, the first heat exchanger 22 of the modular ammonia chiller unit(s) 20 (which serves as a condenser for the hot gas refrigerant from the compressors 64), a receiver 66 (for receiving a supply of condensed liquid refrigerant from the first heat exchanger 22 of the modular ammonia chiller(s) 20, one or more suction line heat exchangers 68, and suitable valves, such as expansion valves 70. Compressors 64 circulates the refrigerant through the low temperature subsystem 60 to maintain cases 62 at a relatively constant low temperature. The refrigerant is separated into liquid and gaseous portions in receiver 66. Liquid refrigerant exits the receiver 66 and is directed to valves 70, which may be an expansion valve for expanding the refrigerant into a low temperature saturated vapor for removing heat from low temperature cases 62, and is then returned to the suction of compressors 64.

Referring further to FIG. 1A, the medium temperature subsystem 80 includes a closed-loop circuit for circulating a chilled liquid coolant (e.g. glycol-water mixture, etc.) through one or more medium temperature cases 82 (e.g., refrigerated display cases, etc.), a supply header 84, a return header 86, a pump 88, and the first heat exchanger 22 of the modular ammonia chiller units 20 (which serves as a chiller for the chilled liquid coolant), and suitable valves 90 for controlling the flow of the chilled liquid coolant through the medium temperature loads of the medium temperature subsystem.

Referring to FIG. 1B, a cascade refrigeration system 110 is shown according to an alternative embodiment, where the medium temperature subsystem 180 may comprise a liquid CO2 branch line 192 from the low temperature subsystem 60, where liquid CO2 is admitted directly into the heat exchangers of the medium temperature loads 182 through a valve 190 (e.g. solenoid valve, etc.). The liquid CO2 typically becomes partially vaporized as it received heat from the medium temperature loads 182 and is then directed back to the receiver 66, where it may then be condensed and cooled by one or more of the modular ammonia chiller units 20.

Referring further to FIG. 2, the modular ammonia chiller units 20 are shown in further detail according to an exemplary embodiment. Chiller units 20 have a closed loop circuit 30 that defines an ammonia refrigerant flow path that includes compressor 24, condenser 26, an ammonia accumulator 32, evaporator 22 and an expansion device 28 (such as an electronic expansion valve for expanding liquid ammonia refrigerant to a low temperature saturated vapor and controlling the superheat temperature of the ammonia refrigerant exiting the evaporator), and a control device 34. According to one embodiment, the compressor 24 is a reciprocating, open-drive, direct-drive type compressor. According to other embodiments, other compressor types may be used, and/or additional components may be included, such as sight glasses, vent valves, and instrumentation such as pressure, flow and/or temperature sensors and switches, etc. Closed loop circuit 30 may also include a vent line 36 with a vent valve or relief valves 38 that are configured to vent the ammonia refrigerant to a header 40 leading to an outdoor location (e.g. above the rooftop of a facility in which the chiller unit is installed, etc.) in the event that venting of the chiller unit 20 is required. Unlike conventional commercial ammonia refrigeration systems, the critical charge nature and the modularity of the chiller unit 20 results in a sufficiently minimal (i.e. substantially reduced) amount of ammonia refrigerant in each chiller unit 20 (e.g. within a range of approximately 5-20 pounds, and more particularly approximately 10 pounds according to one embodiment), so that the ammonia from any one chiller unit 20 may be released to the atmosphere (e.g. at a rooftop location of the facility) at a given time if necessary with minimal or no impact upon flammability or toxicity requirements associated with the locale or facility. Also, since there are no recapture requirements currently associated with ammonia as a refrigerant (as there are with HFC refrigerants), the ease of operation and maintainability of a refrigeration system with the modular ammonia chiller units 20 is further enhanced. According to one embodiment, the modular ammonia chiller units 20 are installed at a rooftop location of the facility and housed within a dedicated enclosure that provides sufficient weather-protection, but is vented (or otherwise non-airtight) to allow any release of ammonia to disperse therefrom (as shown further in FIG. 4).

According to one exemplary embodiment, the modular ammonia chiller units 20 are compact modular chiller units that are critically charged with approximately 10 pounds of ammonia. System 10 may include a multitude of the compact modular ammonia chiller units 20 arranged in parallel as low temperature refrigerant condensing units and/or as medium temperature liquid chillers. The number of compact modular ammonia chiller units 20 may be varied to accommodate various cooling loads associated with a particular commercial refrigeration system. Likewise, the number of medium temperature cases 82 and low temperature cases 62 may be varied.

Figure 4:
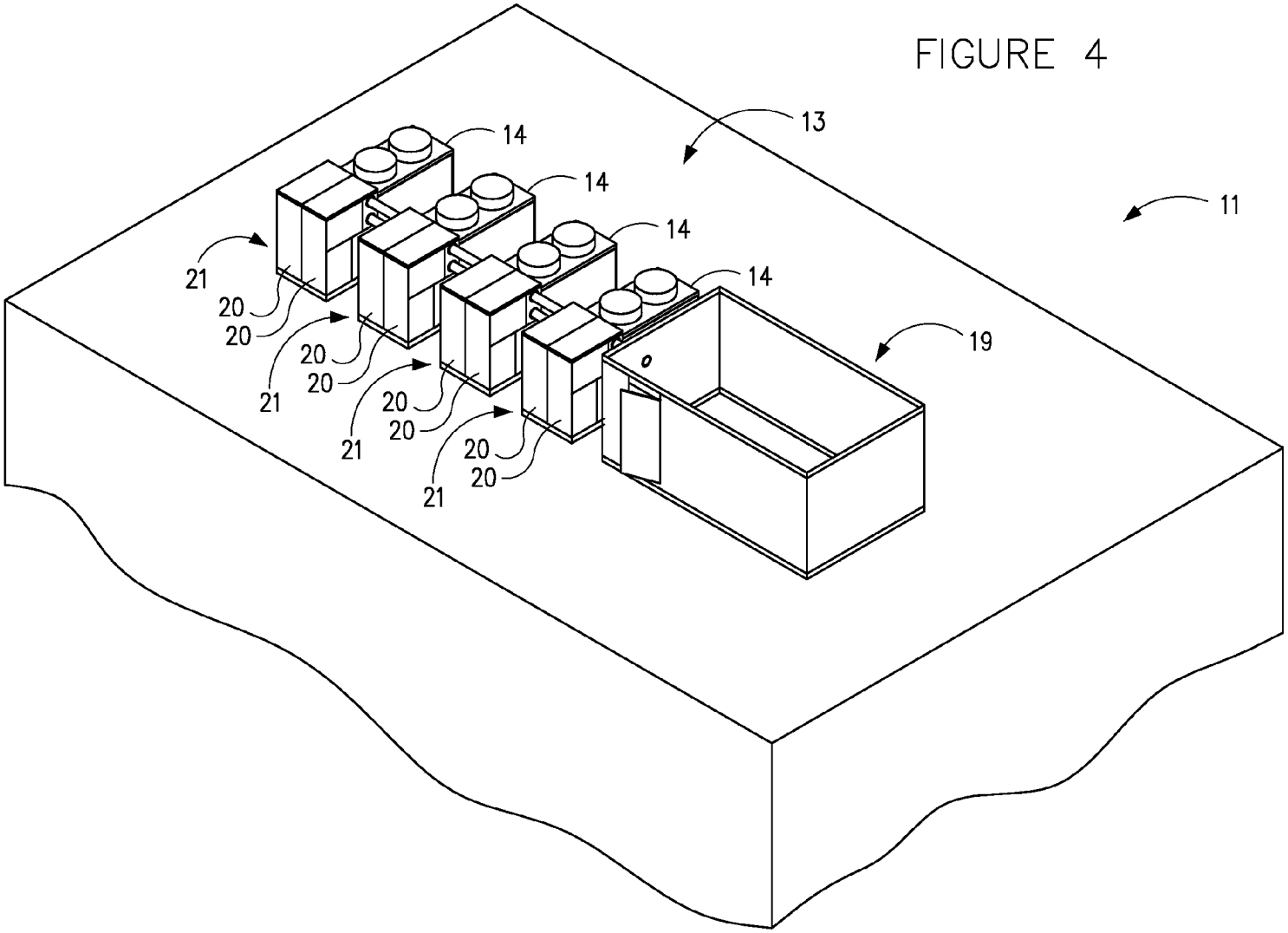
FIG. 4 is a schematic diagram of enclosed modular ammonia chiller units disposed on the rooftop of a facility according to an exemplary embodiment.

Referring to FIG. 4, one embodiment of the commercial cascade refrigeration system having a plurality of compact modular chiller units 20 are shown housed in transportable enclosures for placement on a rooftop 13 (or other suitable location) of a facility 11 is shown. For example, any number of the compact modular ammonia chiller units 20 (shown for example as four groups of two units) that are necessary for a particular commercial refrigeration system design may be pre-mounted to a skid or other platform, and may further by mounted within transportable enclosures 21 for placement at a facility 11 and pre-piped to appropriate supply and return headers, and pre-wired to a suitable electrical connection panel or device, so that the modular chiller units 20 may be shipped as a single unit to a jobsite and quickly and easily connected and powered for use with the lower portion of the cascade commercial refrigeration system 10. In the illustrated embodiment, each transportable enclosure 21 is shown for example to include two modular chiller units 20 housed with the components of an associated water-cooled condensing system 14. The modular chiller units 20 may also be provided with a transportable enclosure such as a mechanical center 19 configured to contain other equipment for the cascade refrigeration system such as control centers, pumps, valves, defrost control panels, and other appropriate equipment.

Notably, in order to provide a chiller unit 20 that is less complex, less expensive, and more easily operated, serviced and maintained by technicians that may otherwise be unfamiliar with ammonia refrigerant systems, the chiller unit does not include an oil management system (e.g. piping, valves, controls, oil reservoir, filters, coolers, separators, float-switches, etc.) for providing lubrication to the compressor. Rather, the modular ammonia chiller unit 20 of the illustrated embodiment uses a soluble oil that is mixed with the ammonia refrigerant to provide lubrication to the compressor. According to one embodiment, the soluble oil is a PolyAlkylene Glycol (PAG) oil, such as a Zerol SHR 1202 ammonia refrigeration oil that is commercially available from Shrieve Chemical Products, Inc. of The Woodlands, Tex. Unlike conventional systems that may use a mineral oil (which is generally insoluble and tends to accumulate in the evaporator and degrade system performance), the PAG oil is soluble within the ammonia refrigerant and thus circulates through the closed loop circuit 30 with the ammonia refrigerant to provide compressor lubrication. Further, although PAG oil is hygroscopic by nature and has an affinity for absorbing water (which is detrimental to the performance of refrigeration systems), the relatively small, modular and "tight" nature of the ammonia chiller units (e.g. with no piping connections associated with a conventional oil system, and that use piping connections that are as leak-tight as possible, etc.), permits the unique usage of PAG oil as a soluble lubricant in an ammonia chiller unit 20.

Figure 5:
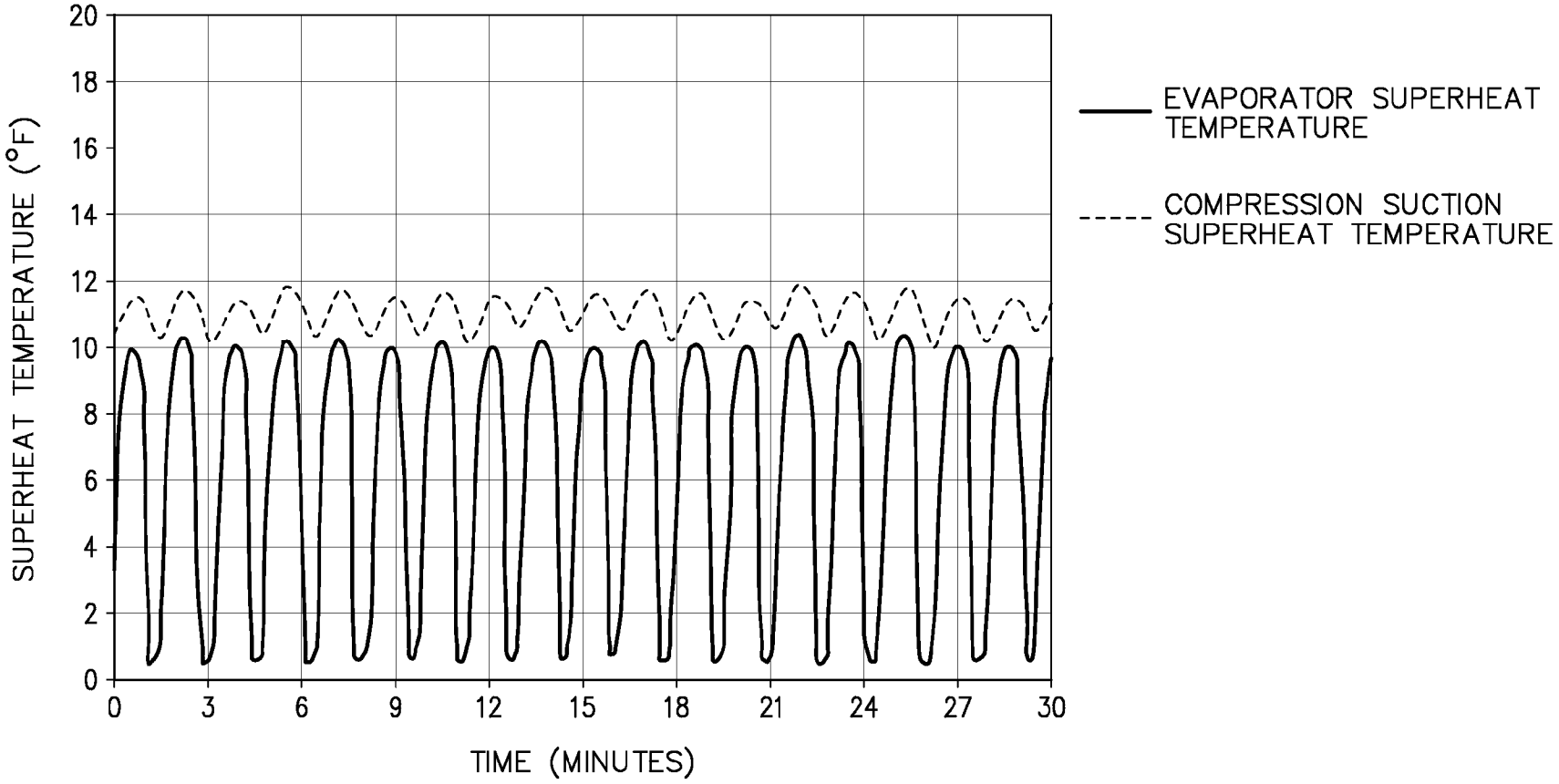
FIG. 5 is a schematic diagram of time vs. superheat temperature data in an intentionally-unstable, over-reactive control scheme for operation of an expansion device for evaporator in the modular ammonia chiller unit of FIG. 2 according to an exemplary embodiment.

In order to provide further improved performance of the compact modular ammonia chiller unit 20 of the present disclosure, control device 34 provides a unique intentionally-unstable control scheme for operation of the expansion device 28 to modulate the superheat temperature of the ammonia refrigerant at the exit of the evaporator 22 between a range of approximately 0-10 degrees F. (although other superheat temperature ranges may be used according to other embodiments). The "superheat temperature" as used in the present disclosure is understood to be the temperature of the superheated ammonia vapor refrigerant (in degrees F.) that is above the saturation temperature of the ammonia refrigerant for a particular operating pressure. For example, a superheat temperature of 10 degrees F. is intended to mean the ammonia is superheated to a temperature that is 10 degrees F. above its saturation temperature at the operating pressure. According to one embodiment, the control device 34 provides a signal to the expansion device 28 to operate the chiller unit 20 with a preferred superheat temperature within a range of approximately 6-8 degrees F. to provide for effective performance of the evaporator 22. However, the control device 34 is also programmed to operate the expansion device 28 in an "intentionally-unstable" manner such that the expansion device 28 modulates (e.g. periodically, cyclically, oscillatory, etc.) to provide a superheat temperature within the range of approximately 0-10 degrees F. over a desired time range, such as approximately 1-2 minutes. Referring to FIG. 5, a control scheme for the intentionally-unstable superheat control is shown according to one embodiment, with superheat temperature proximate the outlet of the evaporator 22, and proximate the suction to the compressor 24, plotted as a function of time (although other superheat temperature ranges and frequency time periods may be used according to other embodiments). As shown by way of example in FIG. 5, the superheat temperature at the outlet of the evaporator 22 according to one embodiment generally oscillates within a range of 0.5-10 degrees F. on a frequency of about once every 1.5-1.7 seconds. However, other specific temperature ranges and time frequencies may be selected to suit a particular application.

According to one embodiment, the control device 34 is (or comprises) a closed-loop proportional-integral-derivative (PID) controller of a type commercially available from Carel USA of Manheim, Pa., and such an intentionally-unstable control scheme may be programmed using appropriate proportional, integral, and/or derivative settings on the controller that may be preprogrammed, or established empirically during an initial system testing and startup operation to be slightly "over-reactive" such that the controller directs the expansion device 28 to reposition in a manner that raises and lowers the superheat setpoint within the desired temperature range and time period. The control settings for the control device 34 may also be set to provide a lower limit for the superheat temperature range, such as a superheat temperature of approximately 1 degree F., according to one embodiment. The applicants believe that by permitting the superheat temperature to occasionally decrease such that the ammonia refrigerant in the evaporator 22 generally remains in a saturated state (i.e. does not become a saturated vapor), any of the soluble oil that may have accumulated within the evaporator 22 can be reabsorbed (due to its solubility in the ammonia refrigerant) and carried-through (e.g. flushed from, etc.) the evaporator and back to (i.e. returned to) the compressor via the ammonia accumulator to ensure positive oil return. The time range setting for the control device 34 is established with the intent to permit a decrease from the optimum superheat temperature only as often as needed to return any accumulating soluble oil from the evaporator 22. Accordingly, the intentionally-unstable operating scheme for the control device 34 is intended to "provide the best of both operating modes" by permitting occasional flushing or returning any accumulating soluble oil from the evaporator 22, while maintaining the superheat temperature within a higher range that is associated with optimum evaporator thermal performance for a majority of the time so that the overall performance of the chiller unit 20 is maintained.

According to an alternative embodiment, the control device 34 may be programmed to return oil from the evaporator 22 to the compressor 24 using a different control scheme. For example, the control device 34 may be programmed to periodically (e.g. on a predetermined frequency) turn-off and then restart the compressor 24 as a method for periodically ensuring positive return of any soluble oil that may have accumulated in the evaporator 22 back to the compressor 24. The frequency of the shutdown-restart operation for each unit 20 may also be based upon a designation of which of the chillers is the "lead" chiller (i.e. the chiller with the most run time, as other of the chillers may be started or shutdown as needed to maintain the desired cooling capacity for the lower portion of the commercial refrigeration system). For commercial refrigeration systems that use multiple modular ammonia chiller units, the shutdown-restart operation and frequency may be established (e.g. sequenced, etc.) so that only one modular ammonia chiller unit is shutdown at any one time. Accordingly, such alternative embodiments are intended to be within the scope of this disclosure.

Figure 3:
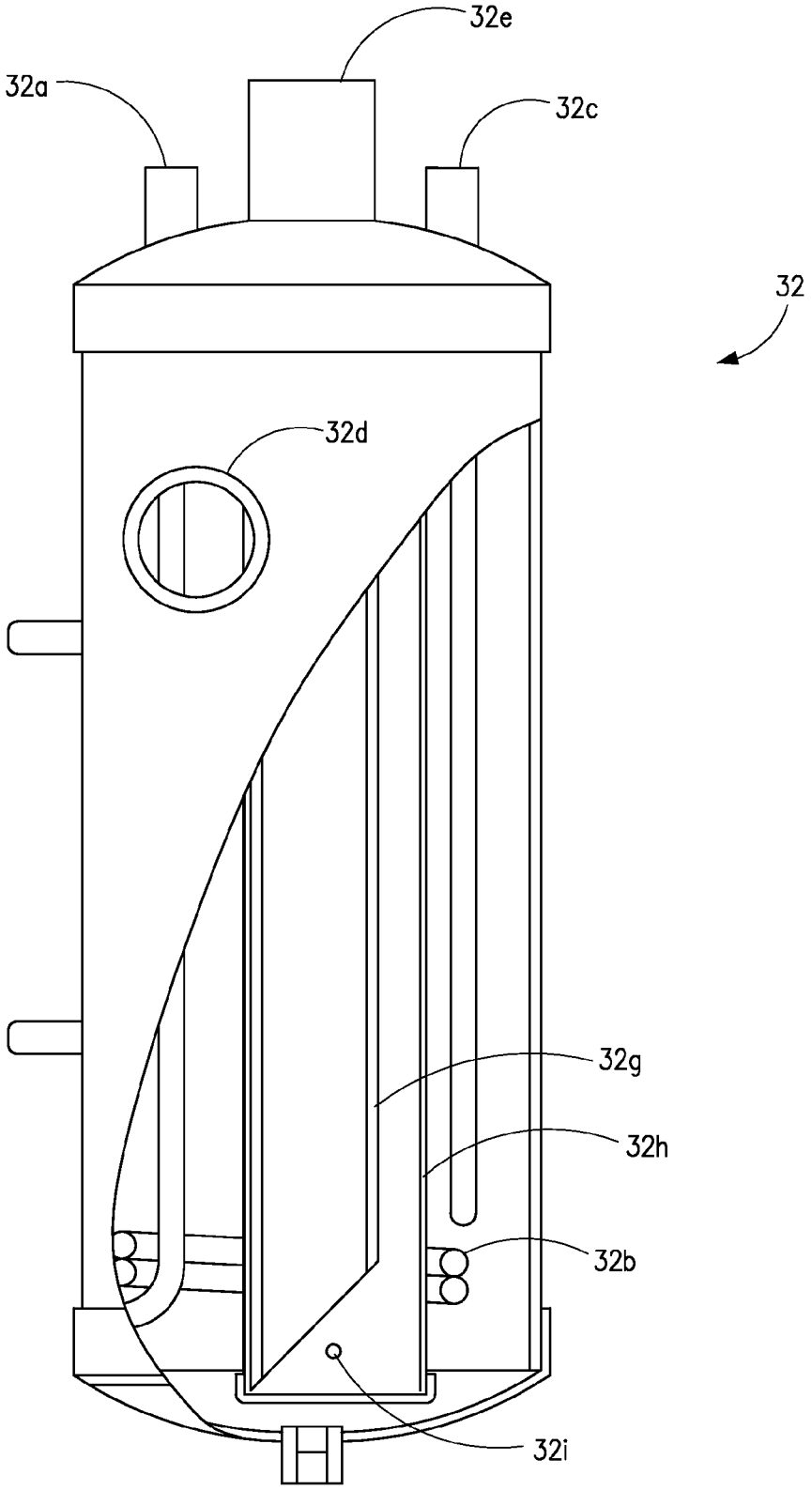
FIG. 3 is a schematic diagram of an ammonia accumulator for the modular ammonia chiller unit for the commercial refrigeration system of FIG. 2 according to an exemplary embodiment.

Referring further to FIGS. 2 and 3, the ammonia accumulator 32 is shown according to an exemplary embodiment. Ammonia accumulator 32 is not intended for use as a receiver or ammonia storage tank or the like, but rather contains primarily ammonia vapor and is a suction line heat exchanger intended to return any liquid soluble oil that is carried-over from the evaporator 22 back to the compressor 24. According to an alternative embodiment, the accumulator 32 may not include suction line heat exchange capability, or such capability may be provided externally from the accumulator. Referring further to FIG. 3, the ammonia accumulator 32 includes a first inlet 32*a* for receiving condensed liquid ammonia from condenser 26, where it is then directed thorough a coil 32*b* and to a first outlet 32*c* for sending the liquid ammonia to the expansion device 28. Ammonia accumulator 32 also includes a second inlet 32*d* on a side of the accumulator 32 which opens to a shell-side of the accumulator and through which ammonia refrigerant is received from the evaporator 22. The returning ammonia refrigerant and soluble oil enter the shell-side of the accumulator 32, where any unabsorbed oil tends to accumulate proximate the bottom of the accumulator 32, and the vaporized ammonia refrigerant and absorbed soluble oil tend to flow upwardly in the shell-side, then downwardly through first tube 32*g* and back up through second tube 32*h* for discharge through a second outlet 32*e* to the suction of the compressor 24. Any liquid soluble oil that has separated from the ammonia tends to accumulate in the bottom of the shell-side, or in the first tube 32*g* where it can drain to the bottom of the shell-side the accumulator 32 (e.g. through an aperture 32*i*, etc.) and may be reabsorbed in the ammonia vapor prior to returning to the compressor suction. According to an alternative embodiment, the accumulated soluble oil may be routed back to a sump portion of the compressor 24 (using appropriate valves and controls—such as a solenoid valve 32*f* operated by a signal from a level switch associated with the accumulator, etc.).

According to any preferred embodiment, a commercial cascade refrigeration system 10 is provided having an upper cascade portion 12 that includes one or more compact modular ammonia chiller units 20 that provide cooling to a lower portion 18 having a low temperature CO2 subsystem 60 and/or a medium temperature chilled liquid coolant subsystem 80, where the ammonia chiller units 20 use a soluble oil for lubrication of a compressor, and in some embodiments an intentionally-unstable superheat temperature control to provide positive return of any accumulated soluble oil from the evaporator 22 back to the compressor 24.

According to the illustrated embodiment of the present disclosure, the use of critically-charged compact modular ammonia chiller units 20 to provide cascade cooling to a low temperature CO2 refrigeration subsystem 60 and a medium temperature chilled liquid coolant (e.g. glycol-water, etc.) subsystem 80 results in an all-natural refrigerant solution for use in commercial refrigeration systems, such as supermarkets and other wholesale or retail food stores or the like, that entirely avoids the use of HFC refrigerants and provides an effective and easily maintainable "green" solution to the use of HFC's in the commercial refrigeration industry. The use of relatively small, critically-charged chiller units 20 permits a series of such modular low-charge devices to be combined as necessary in an upper cascade arrangement 12 in order to cool the load from a large lower refrigeration system 18 using a naturally occurring refrigerant. In addition to being HFC-free, the system as shown and described is intended to have near-zero direct carbon emissions, one of the lowest "total equivalent warming impact" (TEWI) possible, and is intended to be "future-proof" in the sense that it would not be subject to future rules or climate change legislation related to HFCs or carbon emissions.

Referring generally to FIGS. 1-5, any of a number of additional features may be included with the system according to various alternative embodiments. According to one example, the chiller units 20 may include one or more purge ports 42 connected downstream of relief valves 38 as a service feature, so that the various portions of the system may be purged to atmosphere simply by connecting such portion of the system (e.g. by suitable hoses, etc.) to the purge ports. Similarly, the chiller units 20 may include a dump valve 44 that can be programmed to manually or automatically vent the charge of ammonia refrigerant to atmosphere upon the initiation of a predetermined event (e.g. a leak of ammonia if the chiller unit is installed in an indoor or confined space, etc.) as may be required by local fire codes or the like. According to another example, any soluble oil that is accumulated in the evaporator 22 may be siphoned back through a line 46 to an upstream side of the expansion device 28 for reintroduction to the ammonia refrigerant. According to yet another example, the evaporator 22 and condenser 26 of the chiller units 20 may be plate type heat exchangers that are nickel-brazed or all welded stainless steel. According to a further example, one or more heat reclaim devices (e.g. heat exchangers 48, etc.) may be disposed on (or otherwise communicate with) the compressor discharge piping upstream of the condenser to provide heat reclamation for any of a wide variety of heating loads associated with the facility, and also to de-superheat the hot gas ammonia vapor discharged from the compressor 24. According to yet another example, the capacity of the compact modular ammonia chiller units 20 as shown and described in the illustrated embodiments may be approximately 180 kBtu/Hr, and tends to be limited by the size of the plate-type heat exchangers; accordingly, chiller units of increased capacity may be obtained by increasing the size (or heat transfer capability) of the plate type heat exchangers used for the condenser and evaporator of the chiller unit. All such features and embodiments are intended to be within the scope of this disclosure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is important to note that the construction and arrangement of the elements of the refrigeration system provided herein are illustrative only. Although only a few exemplary embodiments of the present invention(s) have been described in detail in this disclosure, those skilled in the art who review this disclosure will readily appreciate that many modifications are possible in these embodiments (such as variations in features such as connecting structure, components, materials, sequences, capacities, shapes, dimensions, proportions and configurations of the modular elements of the system, without materially departing from the novel teachings and advantages of the invention(s). For example, any number of compact modular ammonia chiller units may be provided in parallel to cool the low temperature and/or medium temperature cases, or more subsystems may be included in the refrigeration system (e.g., a very cold subsystem or additional cold or medium subsystems). Further, it is readily apparent that variations and modifications of the refrigeration system and its components and elements may be provided in a wide variety of materials, types, shapes, sizes and performance characteristics. Accordingly, all such variations and modifications are intended to be within the scope of the invention(s).

What is claimed is:

1. A cascade refrigeration system, comprising:

an upper portion having at least two modular chiller units that provide cooling to at least one of a low temperature subsystem having a plurality of low temperature loads, and a medium temperature subsystem having a plurality of medium temperature loads;

the modular chiller units each individually comprising:

a refrigerant circuit having at least a compressor, a condenser, an expansion device, an evaporator, and a header leading to an outdoor location, wherein the refrigerant circuit is a closed-loop circuit between the condenser and the evaporator, wherein the condenser is coupled to a cooling loop that is separate and disconnected from the refrigerant circuit, wherein the evaporator is coupled to a second closed-loop circuit that is separate and disconnected from the refrigerant circuit, and wherein the header is configured to facilitate selective venting of each of the modular chiller units;

an ammonia refrigerant configured for circulation within the refrigerant circuit; and an ammonia refrigerant accumulator configured to receive the ammonia refrigerant from the evaporator, wherein the ammonia refrigerant accumulator contains ammonia vapor and is configured to provide the ammonia vapor to a suction of the compressor without exposing the ammonia vapor to liquid ammonia in the ammonia refrigerant accumulator;

wherein the cooling loop interconnects the modular chiller units.

2. The cascade refrigeration system of claim 1 further comprising both the low temperature subsystem and the medium temperature subsystem, and wherein the low temperature subsystem comprises a CO2 refrigerant, and the medium temperature subsystem comprises a chilled liquid coolant comprising at least one of water and glycol, so that the cascade refrigeration system comprises only naturally-occurring refrigerants and environmentally safe coolants and is substantially HFC-free.

3. The cascade refrigeration system of claim 1 further comprising both the low temperature subsystem and the medium temperature subsystem, and wherein the low temperature subsystem comprises a CO2 refrigerant, and the medium temperature subsystem comprises a CO2 liquid coolant, so that the cascade refrigeration system comprises only naturally-occurring refrigerants and coolants and is substantially HFC-free.

4. The cascade refrigeration system of claim 1 further comprising a soluble oil mixed with the ammonia refrigerant, and wherein the ammonia refrigerant accumulator is configured to receive the soluble oil flushed from the evaporator and return the flushed soluble oil to at least one of the compressors.

5. The cascade refrigeration system of claim 4 wherein the soluble oil comprises a PolyAlkylene Glycol (PAG) oil.

6. The cascade refrigeration system of claim 1 wherein the modular chiller units each individually contain a critical charge amount of the ammonia refrigerant and operate without an ammonia receiver tank.

7. The cascade refrigeration system of claim 6 wherein the critical charge amount of the ammonia refrigerant is less than approximately 20 pounds.

8. The cascade refrigeration system of claim 1 further comprising a control device programmed to modulate the position of at least one of the expansion devices so that a superheat temperature of the ammonia refrigerant proximate an outlet of at least one of the evaporators is intentionally oscillated within a substantially predetermined superheat temperature range.

9. The cascade refrigeration system of claim 8 wherein the predetermined superheat temperature range is within the range of approximately 0-10 degrees F.

10. The cascade refrigeration system of claim 8 wherein the control device is configured to cause an accumulation of a soluble oil in at least one of the evaporators to be at least partially reabsorbed by the ammonia refrigerant as a result of the superheat temperature oscillation and flushed from at least one of the evaporators via the ammonia refrigerant.

11. The cascade refrigeration system of claim 1 wherein the modular chiller units are arranged in a parallel configuration and packaged within at least one transportable enclosure configured for shipping, direct installation at a facility, and operation of the modular chiller units within the at least one transportable enclosure after installation; and wherein at least one of the plurality of low temperature loads the plurality of medium temperature loads is external to the at least one transportable enclosure.

12. The cascade refrigeration system of claim 1 wherein at least one of the evaporators and condensers comprise plate heat exchangers formed at least partially from stainless steel.

13. The cascade refrigeration system of claim 1 wherein the cooling loop comprises one or more heat reclaim devices; wherein at least one of the condensers of the modular chiller units comprises a water-cooled condenser that interfaces with the one or more heat reclaim devices.

14. The cascade refrigeration system of claim 1 wherein at least one of the condensers of the modular chiller units comprises an air-cooled microchannel condenser.

15. The cascade refrigeration system of claim 14 wherein the air-cooled microchannel condenser includes evaporative cooling.

16. The cascade refrigeration system of claim 1 wherein the modular chiller units each further individually comprise one or more heat reclaim devices configured to de-superheat hot gas ammonia refrigerant discharged from the compressor prior to being received by at least one of the condensers.

17. A modular ammonia chiller unit for a refrigeration system, comprising:

a refrigerant circuit having at least a compressor, a condenser, an expansion device, an evaporator, and a header leading to an outdoor location;

an ammonia refrigerant;

a soluble oil mixed with the ammonia refrigerant; and a control device configured to operate the expansion device according to a control scheme comprising:

modulating a position of the expansion device such that a superheat temperature of the ammonia refrigerant proximate an outlet of the evaporator is intentionally oscillated within a superheat temperature range, and causing an accumulation of the soluble oil in the evaporator to be at least partially reabsorbed by the ammonia refrigerant as a result of the superheat temperature oscillation and flushed from the evaporator via the ammonia refrigerant;

wherein the header is configured to facilitate selective venting of the modular ammonia chiller unit.

18. The modular ammonia chiller unit of claim 17 wherein the control scheme comprises periodically stopping and restarting the chiller unit.

19. The modular ammonia chiller unit of claim 17 wherein the control scheme comprises returning the accumulation of the soluble oil from the evaporator through a siphon line to a location in the refrigerant circuit upstream of the expansion device.

20. The modular ammonia chiller unit of claim 17 further comprising an ammonia refrigerant accumulator configured to receive the accumulation of the soluble oil from the evaporator for return to the compressor.

21. A method of providing a cascade refrigeration system that is substantially HFC-free, comprising:

providing a lower portion having at least one of a low temperature subsystem that uses carbon dioxide as a refrigerant to cool a plurality of low temperature loads, and a medium temperature subsystem that uses one of CO2 and a water-glycol mixture as a liquid coolant to cool a plurality of medium temperature loads;

providing an upper portion having at least one modular chiller unit that provides cooling to the low temperature subsystem and the medium temperature subsystem, the modular chiller unit comprising a refrigerant circuit having at least a compressor, a condenser, an expansion device, and an evaporator;

charging the refrigerant circuit of the modular chiller unit with a critical charge amount of an ammonia refrigerant; and programming a control device to operate according to a control scheme comprising modulating a position of the expansion device such that a superheat temperature of the ammonia refrigerant proximate an outlet of the evaporator is intentionally oscillated within a superheat temperature range;

wherein the at least one modular chiller unit is packaged within at least one transportable enclosure configured for shipping, direct installation at a facility, and operation of the at least one modular chiller unit within the at least one transportable enclosure after installation; and wherein at least one of the plurality of low temperature loads and the plurality of medium temperature loads is external to the at least one transportable enclosure.

22. The method of claim 21 further comprising the step of mixing a soluble oil with the ammonia refrigerant, and wherein the control scheme comprises causing an accumulation of the soluble oil in the evaporator to be at least partially reabsorbed by the ammonia refrigerant as a result of the superheat temperature oscillation and flushed from the evaporator via the ammonia refrigerant.

23. The method of claim 22 wherein the control scheme comprises modulating the position of the expansion device so that the superheat temperature of the ammonia refrigerant proximate the outlet of the evaporator is intentionally oscillated within a superheat temperature range of approximately 0-10 degrees F.

24. The method of claim 22 wherein the control scheme comprises periodically stopping and restarting the chiller unit.

25. The method of claim 22 wherein the control scheme comprises returning the accumulation of the soluble oil from the evaporator through a siphon line to a location in the refrigerant circuit upstream of the expansion device.

26. The method of claim 22 further comprising providing an ammonia refrigerant accumulator configured to receive the accumulation of the soluble oil from the evaporator for return to the compressor.

* * * * *